United States Patent [19]

Lorenc

[11] 4,355,944

[45] Oct. 26, 1982

[54] LOADER BOOM POSITION RETAINER

[75] Inventor: Donald D. Lorenc, Mundelein, Ill.

[73] Assignee: Fiat-Allis Construction Machinery, Inc., Deerfield, Ill.

[21] Appl. No.: 864,697

[22] Filed: Dec. 27, 1977

[51] Int. Cl.[3] ..... E02F 9/24

[52] U.S. Cl. ..... 414/685; 298/17 B

[58] Field of Search ..... 214/131 R, 776, 140; 298/17 B; 172/466, 481; 280/515; 85/5 CP; 414/685, 697, 713

[56] References Cited

U.S. PATENT DOCUMENTS

| | | | |
|---|---|---|---|
| 3,183,037 | 5/1965 | Reichert | 298/17 B X |
| 3,730,362 | 5/1973 | Hurlburt et al. | 214/140 |
| 3,957,123 | 5/1976 | Federspiel | 172/481 |

FOREIGN PATENT DOCUMENTS

| | | | |
|---|---|---|---|
| 832997 | 3/1952 | Fed. Rep. of Germany | 280/515 |
| 1827 | 12/1889 | Italy | 280/515 |

*Primary Examiner*—Leslie J. Paperner

*Attorney, Agent, or Firm*—Robert A. Brown; August E. Roehrig, Jr.

[57] ABSTRACT

A safety or lock pin operatively engaged in a portion of the vehicle adjacent to the vehicle lift arm and coupled to the vehicle frame. The safety or lock pin is inserted into the portion associated with the vehicle frame so that the lift arm is prevented from lowering past the safety pin. A retaining pin is engageable in a bracket positioned adjacent the opening for the safety pin to retain the safety pin in its operative position. When in an inoperative position the safety pin is carried in a bracket secured to the vehicle frame and having an aperture through which the retainer pin passes to insure that the safety pin does not become lost during vehicle operation. Suitable safety chains couple the retaining pin to the safety pin, and the safety pin to the vehicle frame to insure that neither pin becomes separated or lost.

9 Claims, 7 Drawing Figures

LOADER BOOM POSITION RETAINER

BACKGROUND OF THE INVENTION

This invention relates in general to safety devices and, in particular, to a locking retainer device for securing a movable linkage mechanism in a position of limited movement.

More specifically, but without restriction to the particular use which is shown and described, this invention relates to a locking retainer for securing a loader boom in an upright or raised position to prevent unintentional lowering of the loader boom or lift arm.

During operation of construction machinery or earthmoving equipment it periodically becomes necessary to service the equipment or to perform preventive maintenance operations. In equipment such as front end loaders, whether they be of the wheel or crawler type, it is necessary to raise or elevate the loader boom or lift arm to effect repairs or preventive maintenance on the front end of the loader because the loading bucket covers this portion of the vehicle when the bucket is in a lowered position. Therefore, the lift arms and loader bucket must be raised and held in an elevated position so that such servicing might be effected. Obviously, the upraised bucket and loader arms positioned above servicing personnel presents a dangerous hazard due to the mass of equipment suspended overhead while servicing is effected. Therefore, it is necessary to latch or lock the lift arm in the raised position so that in the event of any hydraulic failure or inadvertent movement of operator controls effecting the lift arm cylinder, the loader boom will not fall onto anyone servicing the equipment.

Various devices have been utilized in an attempt to lock or retain the lift arms in a raised position to allow safe servicing of the front end of such loaders. Sometimes the lift arm is raised and supported in this position by the use of a stand placed under the loader bucket. However, such stands are frequently not available in field operations and positioning such stands under the loader bucket in and of itself is dangerous because the service personnel must work under the upraised lift arm and buckets to place the stand into proper position. In addition, such stands will fall if the loader is moved and, therefore, do not allow for any movement of the loader during servicing.

Another attempt to retain or lock the lift boom in a raised position is by using sleeve clamps positioned about the push rod of the lift cylinder to prevent the push rod from retracting in the event the hydraulic cylinder or system fails. While such clamp sleeves are somewhat satisfactory, positioning the clamp sleeve about the cylinder rod can be dangerous and can damage the hydraulic lift cylinder.

A further attempt to provide a safety retainer for the loader boom is disclosed in U.S. Pat. No. 3,353,699. The system disclosed therein utilizes a pivotal link which may be pivoted into connection with a link associated with the lift arm belt crank mechanism to prevent the loader boom from lowering. The pivotal link is connected by means of a winghead stud threaded into a socket of the bell crank link. During field operation such threaded sockets can become encrusted and caked with dirt, mud or other materials and the threaded stud can work loose from the threaded socket and become lost due to machine vibrations. Various other such types of retainers have been utilized to prevent rotation of the bucket cylinder bell crank such as disclosed in U.S. Pat. Nos. 3,396,863 and 3,360,146. Each of these mechanisms also relies upon preventing relative movement of various linkage in the lift arm mechanism and thereby impose additional stresses on the linkage couplings. In the event any of these stressed coupling joints would fail, the lift boom would descend onto the servicing personnel.

Another attempt to provide a safety retainer is by the use of a lift arm safety bar such as disclosed in U.S. Pat. No. 3,982,648. A rigid elongated safety bar is pivotally connected between the boom lift arm and lift cylinder to hold the piston rod of the lift cylinder in an extended position when the lift arm is raised to service the loader. A fastener is provided to retain the safety bar in a stored position. Such a system again adds additional stresses to the load boom components.

SUMMARY OF THE INVENTION

It is, therefore, an object of this invention to improve safety devices for maintaining the lift arm of lifting equipment in a raised position.

Another object of this invention is to improve safety devices for lifting equipment by maintaining the lifting boom in a raised position by supporting the upraised lift arm through the equipment frame.

A further object of this invention is to secure the lifting boom of a vehicle in a raised position while allowing the vehicle to be moved with the lifting boom secured in the raised position.

Still another object of this invention is to retain the lifting boom of lifting equipment in an upraised position without entering beneath the upraised boom.

Yet another object of this invention is to insure the retaining mechanism is maintained in a secured position to prevent the mechanism from becoming disengaged or lost.

These and other objects are attained in accordance with the present invention wherein there is provided a safety or lock pin operatively engaged in a portion of the vehicle adjacent to the vehicle lift arm and coupled to the vehicle frame. The safety pin or lock pin is inserted into the portion associated with the vehicle frame so that the lift arm is prevented from lowering past the safety pin. A retaining pin is engageable in a bracket positioned adjacent the opening for the safety pin to retain the safety pin in its operative position. When in an inoperative position the safety pin is carried in a bracket secured to the vehicle frame and having an aperture through which the retainer pin passes to insure that the safety pin does not become lost during vehicle operation. Suitable safety chains couple the retaining pin to the safety pin, and the safety pin to the vehicle frame to insure that neither pin becomes separated or lost.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF A PREFERRED EMBODIMENT

Figure 1:
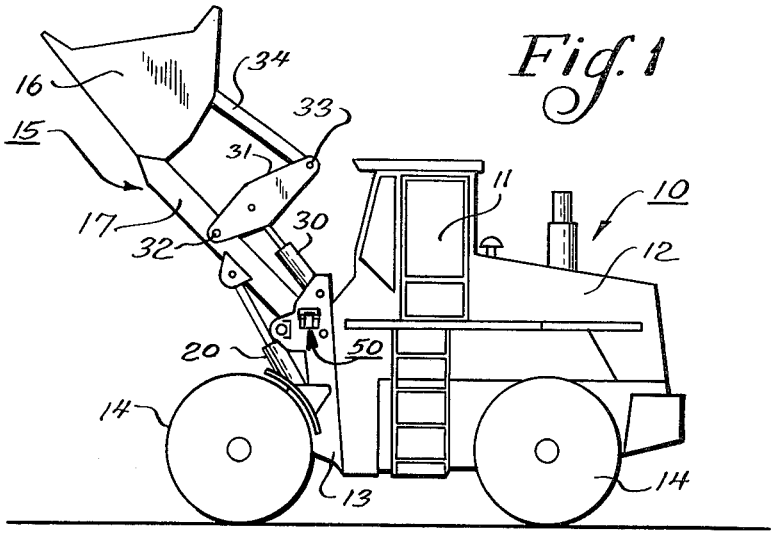
FIG. 1 is a side elevational view of a wheel type front end loader embodying the invention.

Referring now to FIG. 1, there is shown a construction machine or earthmoving vehicle 10 of a type referred to as a front end wheel loader. While the instant invention is believed to have general utility with any type of equipment employing a lifting boom, for convenience of illustration the invention will be described with reference to a wheel loader of the type illustrated in FIG. 1.

As is well known, the wheel loader 10 comprises a cab portion 11, from which the operator controls the vehicle and the associated implements, and an engine compartment 12. The cab 11 and engine compartment 12 are carried on a vehicle frame 13 which is supported for movement by two pairs of wheels 14. On the front end of the wheel loader 10 is carried a lift boom 15 which includes a bucket 16 for moving materials and a lift arm 17. The bucket 16 is supported for pivotal movement on one end of the lift arm 17. The lift arm 17 is connected at one end to the bucket 16 and at its opposite end to the vehicle frame 13 for pivotal movement relative to the loader 10. A hydraulically actuated lift cylinder 20 is coupled between the frame 13 of the vehicle and the lift arm 17 and is actuable in response to the apparatus controls to effect raising and lowering of the bucket 16 and lift arm 17. A hydraulically actuated bucket cylinder 30 is pivotally connected at one end to a portion of the frame 13 and at its opposite end to a bell crank 31 to effect rotational movement of the bell crank in response to movement of the piston rod of the bucket cylinder. The bell crank 31 is secured at one end 32 to the lift arm 17 and at its opposite end 33 to a bucket link 34 connected between the bell crank and a portion of the bucket 16. Upon actuation of the bucket cylinder 30 the bucket 16 is, therefore, pivotally moved relative to its supporting end on the lift arm 17 to load, carry, or dump material in the bucket.

During operation, the lift boom 15 is lowered and the bucket 16 rotated by means of operation of the bucket cylinder 30 such that the vehicle 10 may be moved forward into material such as earth, gravel, or sand. The bucket cylinder 30 is then actuated while the lift cylinder 20 raises the lift boom 15 into a raised position. During this movement the bucket cylinder 30 is actuated such that the bucket is rotated to retain the contents in the bucket 16. The vehicle 10 may be moved during this time to a position, usually adjacent a hauling vehicle, whereat the bucket 16 is rotated in response to the actuation of the bucket cylinder 30 to dump the contents from the bucket. In order to dump the bucket the lift arm 17 is maintained in its upright position and the bucket cylinder 30 actuated to rotate the bell crank 31 thereby rotating the bucket 16 to dump the contents therefrom.

When it becomes necessary to service the forward portion of the loader vehicle 10, either for replacing parts or preventive maintenance, the lift boom 15 must be raised to an uppermost position to allow or facilitate access to the forward portion of the loader. In order to insure the safety of an operator or service personnel working beneath the upraised lift arm 17 and bucket 16, a safety device 50 is used to maintain the lift arm 17 and bucket 16 in the raised position to prevent injuries which would result if the vehicle hydraulic system should fail or if operator controls were inadvertently moved while the lift boom 15 is in the upraised position.

The safety device 50 is best shown in FIGS. 2–7, and comprises a lock or safety pin 51 for maintaining the lift arm 17 and bucket 16 in a raised position by providing a bearing support or stop which is connected to the vehicle frame. In coupling the lock pin 51 to the vehicle frame, no additional stresses are imposed on the components of the lift boom linkage pivots. For ease of insertion and removal of the lock pin 51, and to facilitate storage, the lock pin is formed with a generally U-shaped handle 55 fastened across one end of the pin. A chain or retaining line 56 is coupled between the handle 55 and a portion of the vehicle frame to prevent loss of the lock pin when not in use.

Figure 2:
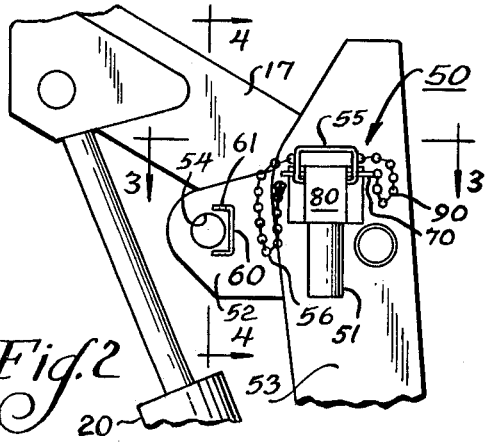
FIG. 2 is an enlarged view of a portion of the wheel loader vehicle shown in FIG. 1 illustrating the load boom retainer device in its inoperative position secured to the frame of the vehicle.
Figure 5:
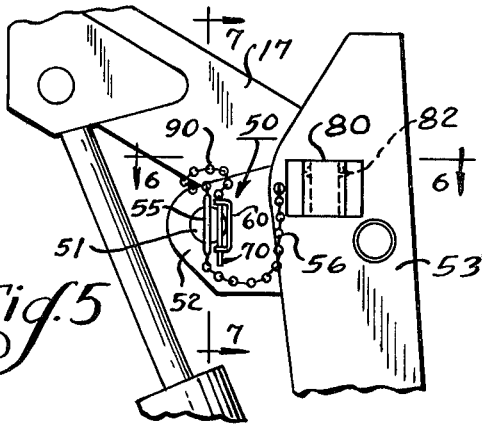
FIG. 5 is an enlarged view as in FIG. 2 showing the load boom retainer device in engagement with a portion of the vehicle operatively connected to the vehicle frame to prevent the lift arm from being lowered beyond the safety or lock pin.
Figure 3:
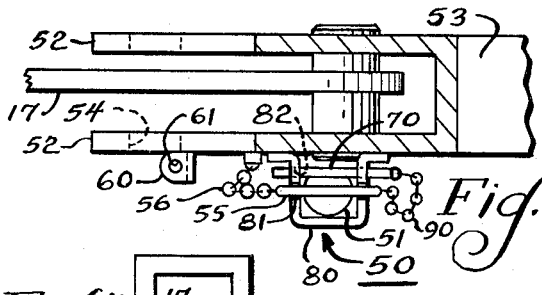
FIG. 3 is a sectional view of a portion of the apparatus shown in FIG. 2 taken along lines 3—3.
Figure 6:
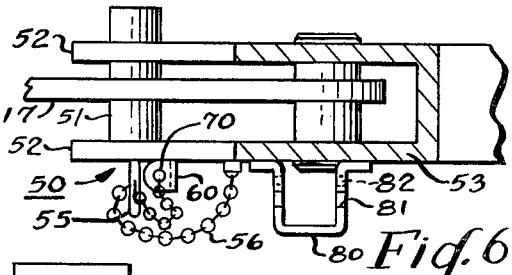
FIG. 6 is a sectional view of a portion of the apparatus shown in FIG. 5 taken along lines 6—6.
Figure 4:
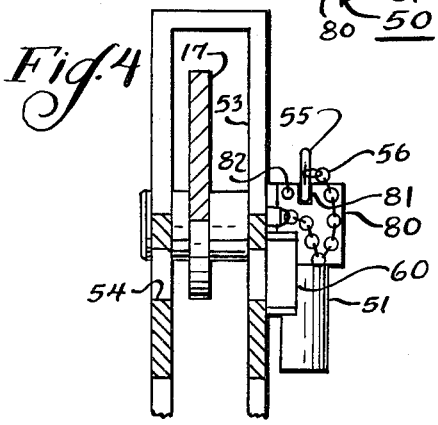
FIG. 4 is a sectional view of a portion of the apparatus shown in FIG. 2 taken along lines 4—4.
Figure 7:
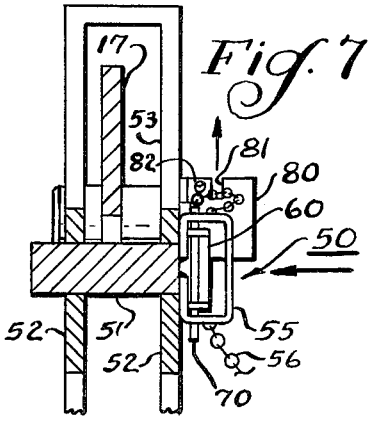
FIG. 7 is a sectional view of a portion of the apparatus shown in FIG. 5 taken along lines 7—7.

A pair of load bearing or stop supports 52 are secured to or formed as a portion of a vehicle support member 53 which forms a portion of the vehicle frame. The bearing supports 52 are positioned adjacent and parallel to the lift arm 17 as best shown in FIGS. 3, 4, 6 and 7. The load bearing supports 52 are each formed with an aperture 54 into which the lock pin 51 is placed to form a barrier or stop to prevent the lift boom 15 from rotating in a counterclockwise direction (as shown in FIGS. 2 and 5) thereby maintaining the lift arm 17 and bucket 16 in the upraised position. A U-shaped retainer pin bracket 60 is fastened to one of the bearing supports 52 adjacent to the aperture 54 with a portion of the aperture 54 extending within the U-shape defined by the bracket 60. The bracket 60 is formed with a keeper pin aperture 61 within which a keeper or retainer pin 70 may be inserted after the lock pin 51 has been placed in the aperture 54 to prevent unintentional removal of the lock pin.

When the lock pin 51 is not in operative position to retain the lift boom 15 in an upraised position, the pin is stored in a storage bracket 80 secured to the frame member 53 as by welding. The bracket 80 is formed in a U-shaped configuration extending outwardly from the frame member 53 and the lock pin 51 is stored by placing the pin into the top thereof. The handle portion 55 of the lock pin engages a recess 81 in the storage bracket 80. A keeper pin aperture 82 is formed in a portion of the storage bracket 80 such that after the retainer or keeper pin 70 is inserted through the aperture 82, the lock pin 51 cannot become accidentally or unintentionally dislodged from its storage bracket during machine operation. A chain or retaining line 90 is connected between the handle 55 of the lock pin 51 and the retainer pin 70 to prevent the retainer pin from becoming separated from the lock pin.

When it is desired to retain the lift boom 15 in a raised position, and to insure that the lift boom cannot be lowered after the lift arm has been raised into an upright position above the area of the aperture 54 formed in the loading bearing supports 52, the keeper pin 70 is removed from the keeper pin aperture 82 in the storage bracket 80 and the lock pin 51 removed therefrom and placed through the apertures 54 in the load bearing supports 52. The lock pin 51 thereby extends between the two parallel and adjacent bearing supports 52 such that the lift boom 15 cannot be lowered beyond contact with the lock pin. When the lift boom 15 is lowered into contact with the lock pin 51, all of the downward force will be transmitted to the vehicle frame 13 without imposing any additional stress forces on the pivotal elements or linkages of the lift boom 15. The retainer or keeper pin 70 is then placed through the keeper pin apertures 61 of the bracket 60 to prevent the lock pin 51 from becoming accidentally or unintentionally dislodged from its operative position thereby insuring that the lift boom 15 is maintained in a raised position. In this manner when the lock pin 51 is inserted in the apertures 54 formed in the bearing supports 52 to prevent the lift boom 15 from being lowered, the retainer or keeper pin 70 will insure that the lock pin 51 does not become accidentally dislodged either while the vehicle is being serviced or moved with the bucket and lift arm being in the upright or raised position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a lifting apparatus having a lifting boom pivotally supported relative to a support frame and operable into a raised overhead position, a safety device for maintaining the lifting boom in the raised position comprising load bearing support means operatively connected to a support frame and positioned adjacent a movable lifting boom pivotally supported from the support frame for retaining the lifting boom in a raised position, said load bearing support means having an aperture formed therein located at a position beneath the movable lifting boom when the lifting boom is pivoted into the raised position, and lock pin means insertable through said aperture formed in said load bearing support means to prevent the lifting boom from pivotally moving downward from a raised position, bracket means carried by said load bearing support means and positioned adjacent said aperture formed therein, and retainer pin means operatively engageable with said bracket means to retain said lock pin means in said aperture.

2. The apparatus of claim 1 wherein said load bearing support means comprises at least two parallel support plates positioned adjacent said movable lifting boom.

3. The apparatus of claim 1 further including coupling means forming a flexible connection between said retainer pin means and said lock pin means to limit the extent of the separation thereof.

4. The apparatus of claim 1 wherein said bracket means includes an aperture formed therein for insertion of said retainer pin means thereinto.

5. The apparatus of claim 1 further including coupling means forming a flexible connection between said lock pin means and said load bearing support means to limit the extent of the separation thereof.

6. The apparatus of claim 1 further including storage bracket means carried by said load bearing support means for carrying said lock pin means when removed from said aperture.

7. The apparatus of claim 6 further including retainer pin means operatively engageable with said storage bracket means to retain said lock pin means therein.

8. The apparatus of claim 6 wherein said storage bracket means includes a recess for engaging a portion of said lock pin means to position said lock pin means therein.

9. The apparatus of claim 7 wherein said storage bracket means includes an aperture formed therein for insertion of said retainer pin means thereinto.

* * * * *